US005933801A

United States Patent [19]

Fink et al.

[11] Patent Number: 5,933,801

[45] Date of Patent: Aug. 3, 1999

[54] METHOD FOR TRANSFORMING A SPEECH SIGNAL USING A PITCH MANIPULATOR

[76] Inventors: Flemming K. Fink, Lundegårdsvej 38, DK-9490 Pandrup; Uwe Hartmann, Solbakken 36, DK-9210 Aalborg SØ; Kjeld Hermansen, Stammen 67, DK-9260 Gistrup; Per Rubak, Rosenparken 46, DK-9240 Nibe, all of Denmark

[21] Appl. No.: 08/836,313

[22] PCT Filed: Nov. 27, 1995

[86] PCT No.: PCT/DK95/00474

§ 371 Date: Jul. 2, 1997

§ 102(e) Date: Jul. 2, 1997

[87] PCT Pub. No.: WO96/16533

PCT Pub. Date: Jun. 6, 1996

[30] Foreign Application Priority Data

Nov. 25, 1994 [DK] Denmark ..... 1347/94

[51] Int. Cl.[6] ..... G10L 9/02

[52] U.S. Cl. ..... 704/208; 704/207; 704/219; 704/233

[58] Field of Search ..... 704/208, 233, 704/207, 219, 224, 230, 266, 263, 236, 209; 381/68, 68.2, 68.4

[56] References Cited

U.S. PATENT DOCUMENTS 3,649,765 3/1972 Rabiner et al. .
4,222,393 9/1980 Hocks et al. .
4,845,753 7/1989 Yasunaga .
5,060,268 10/1991 Asakawa et al. .
5,717,821 2/1998 Tsutsui et al. ..... 704/205
5,732,392 3/1998 Mizuno et al. ..... 704/233

FOREIGN PATENT DOCUMENTS 0 527 527 A2 2/1993 European Pat. Off. .
WO 95/26024 9/1995 WIPO .

*Primary Examiner*—David R. Hudspeth
*Assistant Examiner*—Vijay B. Chawan
*Attorney, Agent, or Firm*—Finnegan, Henderson, Farabow, Garrett & Dunner, L.L.P.

[57] ABSTRACT

Transformation of a speech signal comprises separating the speech signal into two signal parts (a, b), where (a) represents the quasistationary part and (b) the transient part of the signal. The signal (b) is filtered inversely and is supplied in parallel to a transient detector and a pitch manipulator, while the signal (a) is subjected to a spectral analysis. The transformation circuit permits well-defined manipulation of any speech signal, which is advantageous partly for hearing-impaired persons, partly for persons having normal hearing ability in noisy environments. Finally, the circuit has been found to be extremely expedient for synthesizing well-defined sounds, which is of great importance in the control of hearing aids (hearing loss simulator).

9 Claims, 5 Drawing Sheets

METHOD FOR TRANSFORMING A SPEECH SIGNAL USING A PITCH MANIPULATOR

BACKGROUND OF THE INVENTION

The invention concerns a method of transforming a speech signal which is separated into two signal parts a, b, where a represents the quasistationary part of the signal with information on the formant frequencies, and b represents a residual signal, the transient part of the signal, containing information on pitch frequency and stop consonants, the signal b being produced by inverse filtration of the speech signal.

Such a method is known from U.S. Pat. No. 5,060,258 and from articles by U. Hartmann, K. Hermansen and F. K. Fink: "Feature extraction for profoundly deaf people", D.S.P. Group, Institute for Electronic Systems, Alborg University, September 1993, and by K. Hermansen, P. Rubak, U. Hartman and F. K. Fink: "Spectral sharpening of speech signals using the partran tool", Alborg University.

As described in the above articles, a speech signal is divided into two signal parts, one of which is described by a spectrum, and the other is a time signal. The spectral signal may be calculated on the basis of LPC (linear predictive coding), on the basis of FFT transformation or in another manner. The spectrum produced by the analysis is divided into a plurality of second order parallel sections, and as disclosed by the articles, the sections are characterized by three parameters, which are the resonance frequency $f_o$, the Q value $$Q = \frac{f_0}{f_3}\text{dB}$$

and the power of the spectral part which is about the frequency $f_o$. With these three parameters it is possible to transform (i.e. manipulate) the LPC or FFT spectrum. Further, this signal is typically composed of so-called formants, which are resonance frequencies in the vocal tract, or put differently, the signal describes a considerable part of the information content of a speech signal.

The second signal produced via an LPC analysis (inverse filtration) is a residual signal which in respect of voiced sounds is indicative of the tone or pitch of a speech signal, which is typically in the range from 100 to 300 Hz. For example, a male voice has a low frequency, while a female voice has a somewhat higher value. The above-mentioned tone frequencies or pitch frequencies are defined as the-number of pulses per second which are generated by the vocal chords.

Now, by means of the two subsignals it is possible to manipulate speech signals in several ways for use in many applications, as will appear from the following.

For example, transformation of speech signals of the above-mentioned type may be used for:

a) Changing the sound picture with a view to improving the speech intelligibility in noisy environments for persons having normal as well as impaired hearing ability.
b) Changing the sound picture with a view to improving the speech intelligibility and comfort of persons with severely impaired hearing.
c) Simulating hearing losses, e.g. for use in the testing of hearing aids.

As mentioned, according to the above-mentioned articles, the great advantage of the transformation of speech signals is that it is possible manipulate the formant frequencies as well as the residual signal independently of each other. The fact is that if a complete speech signal is compressed/expanded by more than 10% (for persons with normal hearing), the speech quality will be partially destroyed. This restriction does not apply to the same extent, if the pitch signal is maintained and the formant frequencies are reduced.

However, it has been found that the signal processing according to the above-mentioned articles may be improved. If, for example, a door slams, a hearing-impaired person carrying a hearing aid of any type can easily get an unpleasant surprise, because the circuit of the hearing aid is not sufficiently fast to attenuate this sudden signal.

In the circuit mentioned in the articles above, a so-called sound transient, such as e.g. the slam of a door, will substantially not be modeled by the LPC analysis, but will occur in the residual signal as a rather strong pulse.

Accordingly, it is the object of the invention to eliminate this noise signal in the residual channel.

SUMMARY OF THE INVENTION

This object is obtained by a method of transforming a speech signal, comprising separating the speech signal into two signal parts a, b, where a represents the quasistationary part of the signal with information on the formant frequencies, and b represents a residual signal with the transient part of the signal containing information on pitch-frequency and stop consonants, said signal b being produced by inverse filtration of the speech signal, characterized in that, after the inverse filtration, the signal b is supplied in parallel to a transient detector and a pitch manipulator comprising a delay circuit which is serially coupled to a multiplier to which the output signal is supplied from the transient detector.

Signal pulses are captured in this manner by the transient detector, and since the signal to the multiplier is delayed with respect to the signal arriving from the transient detector, it is possible to eliminate the noise pulse by means of the multiplier. Further, it is extremely essential that the elimination of the noise pulse can take place completely independently of the signal processing in the other signal part, which comprises manipulation of the formant frequencies.

The output signal from the multiplier is supplied to a pitch converter. The pitch frequencies may hereby be changed independently of the signal processing of the formant frequencies. This means that a voice, without any change it is characteristic contents, may be transformed to another pitch.

In some cases it may be expedient in noise/transient elimination that the transient detector is connected to an output from a spectral calculation circuit having its input connected to the signal a, since this results in the incorporation of spectral information from the LPC analysis.

Finally, it is expedient that the residual signal b, which contains pitch frequency, sound transients, if any, and stop consonants, may be manipulated independently of each other by means of the pitch manipulator.

This is possible, because sound transient pulses, pitch pulses and stop consonant pulses have a different appearance. In other words, e.g. a noise pulse which is eliminated, does not affect pitch frequency or stop consonants.

Since the residual signal b i.a. contains pitch pulses, stop consonants and noise transients, if any, as time sequential signal elements, these different signal elements may consequently be amplified/attenuated independently of each other. This is done by means of a multiplier, where the amplification factor (or attenuation factor) "is controlled by" a transient detector which classifies the various time sequential signal elements (pitch pulses, stop consonants, etc.). Owing to an inevitable delay in connection with the classification (see item B) of the various signal elements, a delay link has been added in front of the multiplier. Depending upon the classification, the multiplier is adjusted to an amplification factor of less than 1, equal to 1 or greater than 1.

The classification of occurring transient signals in the residual signal b takes place on the basis of both the amplitude spectrum (frequency domain) and the residual signal (time domain).

The frequency composition of the time signal segment concerned is determined. This is indicated in FIG. 7, where the transient detector 15 receives information on the spectral composition from block 12 (calculation of spectrum).

Pitch pulses and stop consonants may be distinguished from each other, as the stop consonants have considerably more signal power concentrated in the high frequency range (frequency domain).

Noise transients may be distinguished from the other signal elements by means of a simple level detector, as noise transients contain peak amplitudes (in the time domain, i.e. the residual signal b) which are much higher than those of the "speech sounds".

It is moreover possible in principle to use some very advanced pattern recognition methods which have been developed in connection with speech recognition (e.g. classification based on cepstral coefficients).

When the strength-dynamic variation of the individual formants may be compressed in relation to the actual dynamic range of the hearing impaired person, which depends on the frequency range in which the individual formant is present, it is ensured that the strength variation of the "compressed formant" keeps within a range which is called UCL (uncomfortable level) and is downwardly limited by an increased hearing threshold. (As a typical hearing loss increases toward higher frequencies, the strength-dynamic compression must usually be increased toward higher frequencies). This strength compression just concerns the "a channel". In other words, the pitch signal in the residual channel is not affected by strength compression, as is the case in conventional analog multi-channel compression hearing aids.

The invention also concerns an apparatus for transforming a speech signal, comprising a circuit for splitting the signal into two parts a, b where the first part is supplied to a decomposition circuit in series with a transformation circuit, and the other b is supplied to a circuit for inverse filtration. This apparatus is characterized in that the output from the circuit is connected in parallel to a transient detector and a pitch manipulator comprising a series connection of delay circuit and a multiplier circuit to which the output from the transient detector is connected.

The signal processing system of the invention is extremely useful particularly in connection with hearing aids, since it is possible to manipulate signals to the hearing aid, as regards transformation of frequencies from one range to another as well as selective change of the strength conditions. For example, it is frequently desirable to transform the high frequencies to a lower frequency range, since most of the hearing injuries occur at high frequencies. It is an advantage in this connection that the signal information is substantially intact, so that the hearing-impaired person will benefit from the information which persons of normal hearing ability receive in a wider frequency range. As mentioned, it is also advantageous that noise pulses may be eliminated, since they can be very uncomfortable to the hearing-impaired persons.

As mentioned before, the spectrum (e.g. calculated via LPC or FFT) may be decomposed/divided into a plurality of second order sections having a specific centre frequency, bandwidth and strength.

The second order sections may be numbered according to increasing centre frequency. The sections having odd numbers are phase-shifted 180 degrees to prevent destructive interference after the summation.

The first section (No. 1) is padded with a zero for z=−1. The last section is padded with a zero for z=+I. All the other sections are padded with zeros at both z=−1 and z=+1.

LPC analysis is used for calculating the inverse filter, as mentioned before. The Q value of the zeros of the inverse filter may be adjusted adaptively via a factor alpha (typically 0.95–0.99), which is multiplied on all LPC coefficients. This adjustment is made in connection with the handling of pure tone signals which can be very pronounced for some female voices (and children's voices).

The very flexible signal processing according to the invention also allows speech to be synthesized. This has many applications, and the most interesting one is perhaps that it is now possible to produce synthesized speech where all parameters are known, which is an advantage particularly when testing hearing aids.

BRIEF DESCRIPTION OF THE DRAWINGS

The invention will now be explained more fully below with reference to the drawing, in which.

DETAILED DESCRIPTION OF THE INVENTION

Figure 1:
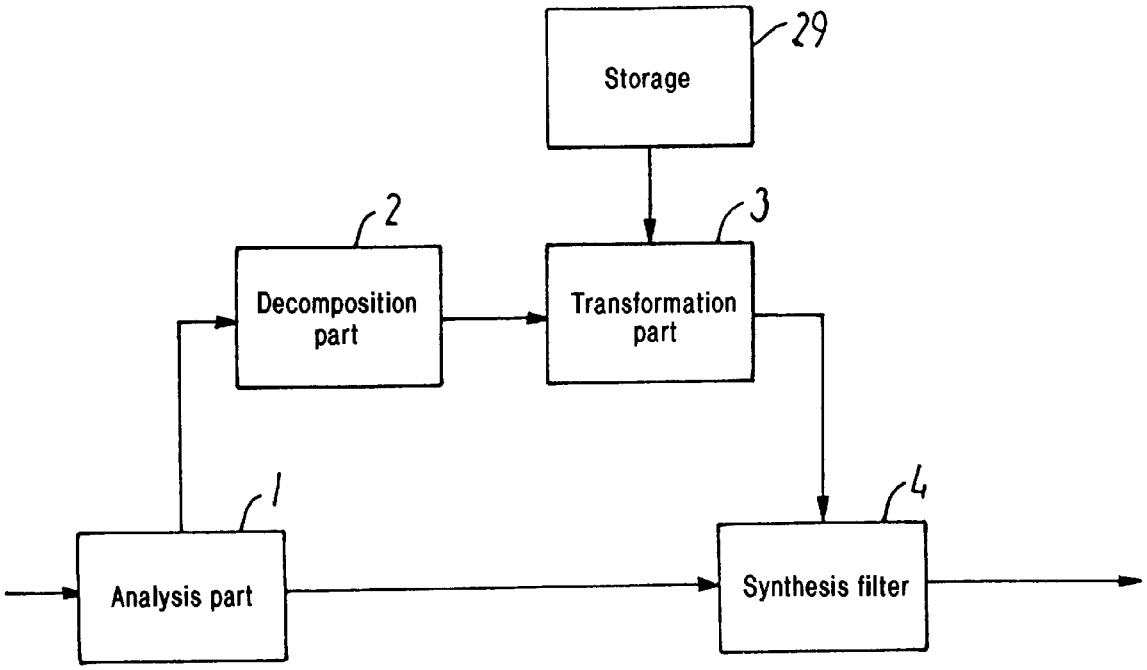
FIG. 1 PRIOR ART
FIG. 1 shows a block diagram of a known signal transformation circuit.

As will be seen from FIG. 1, which shows a block diagram of a circuit for modifying a speech signal, the circuit consists of an analysis part 1 which splits the signal into two parts, one part of which consists of a decomposition part 2 and a transformation part 3 and is conducted in one branch, while the other part is a residual signal and is conducted in another branch, following which synthesis in the filter block 4 takes place to provide a modified speech signal. It will moreover be seen that the input of the transformation part is connected to a storage 29 which contains personal data, e.g. information on measured UCL, cf. the following, or on increased hearing threshold.

Figure 2:
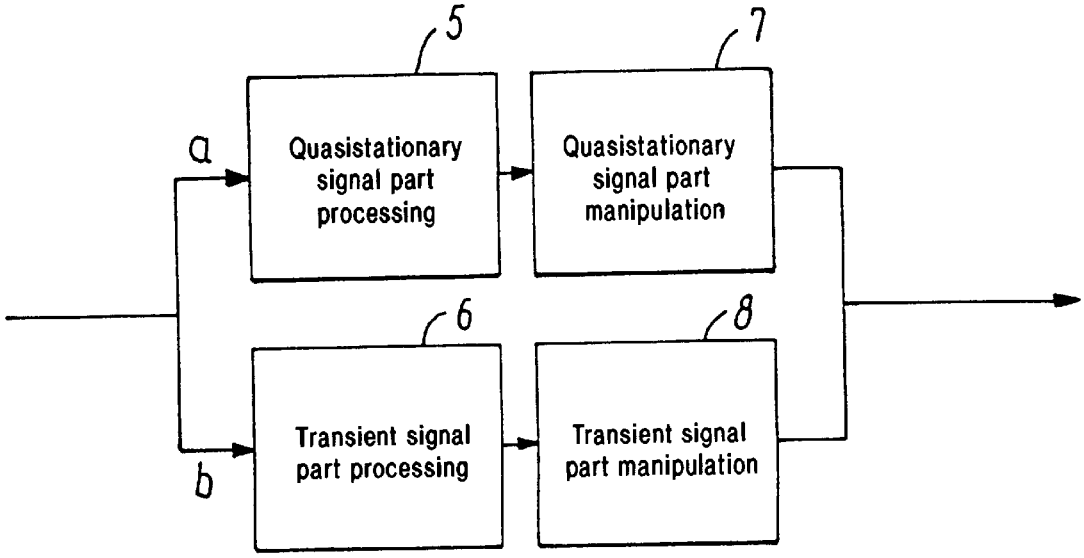
FIG. 2 PRIOR ART
FIG. 2 shows the principles in block diagram view of the signal processing in the circuit shown in FIG. 1.

FIG. 2 shows more concretely how the two signal parts are processed, where one signal part designated a processes the quasistationary part of the signal in the block 5, which is then manipulated in the block 7, while the other signal part b processes the transient part in the block 6, which may likewise be manipulated in the block 8, and the two manipulated signals are coupled to modified speech signal. It is noted that the signal a is produced by decomposing the speech signal in a spectrum which is arranged in second order units, more particularly they are parallel-divided so that each part represents a formant frequency which is described by its power, its resonance frequency $f_o$ and the Q value, $$Q = \frac{f_0}{f_3}\text{dB}$$

As the signal is thus divided into parallel parts, it is now possible to manipulate the individual parts on the basis of the above three parameters. In other words, the signal a, which contains—information on the contents of a speech signal, may be manipulated in a flexible manner. For example, it will be possible to sharpen the formant frequencies by reducing the bandwidth. Of course, nothing prevents some frequency bands from being omitted in the transformation. The other part of the speech signal b, the residual signal, includes the pitch frequency, which in respect of voiced sounds is indicative of the tone, which is typically in the range from 100 to 300 Hz. In this part, the pitch frequency may be manipulated completely independently of the formant frequencies, which means that e.g. a male voice may be transformed to a child's voice without anything of the information in the speech signal being lost. An example of signal processing in the circuit mentioned above is shown in FIG. 3, which shows the quasistationary part of an LPC spectrum for the word "pølsevognen", without noise contamination. FIG. 4 shows the residual signal for the same word, while FIG. 5 shows a spectrum after it has passed through the circuit in FIGS. 1 and 2, the spectral parts having been sharpened, or rather more clearly separated from each other. The signal processing in FIG. 5 has been performed by changing the bandwidth while maintaining the two other parameters, which are the power in the spectrum and the resonance frequency.

Figure 3:
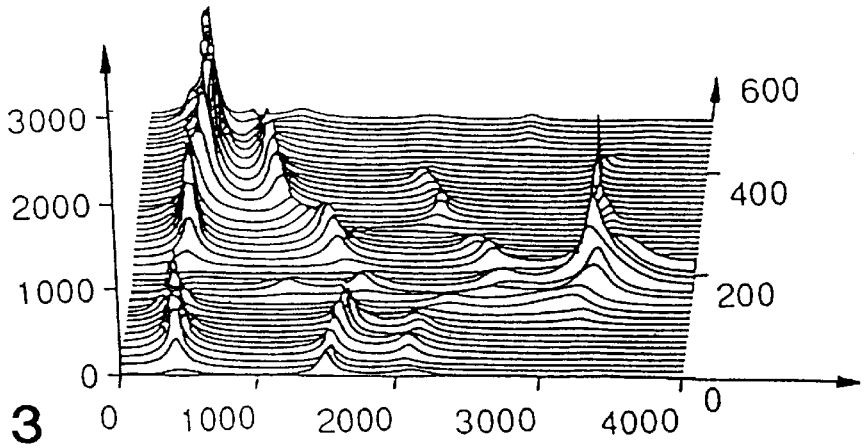
FIG. 3 PRIOR ART
FIG. 3 shows the spectral signal in one channel.
Figure 4:
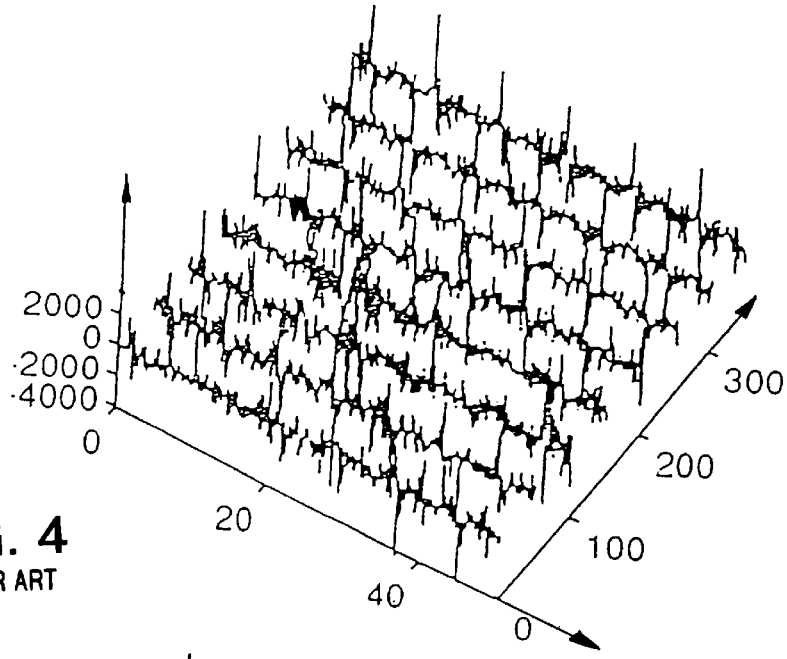
FIG. 4 PRIOR ART
FIG. 4 shows the residual signal in the other channel.
Figure 5:
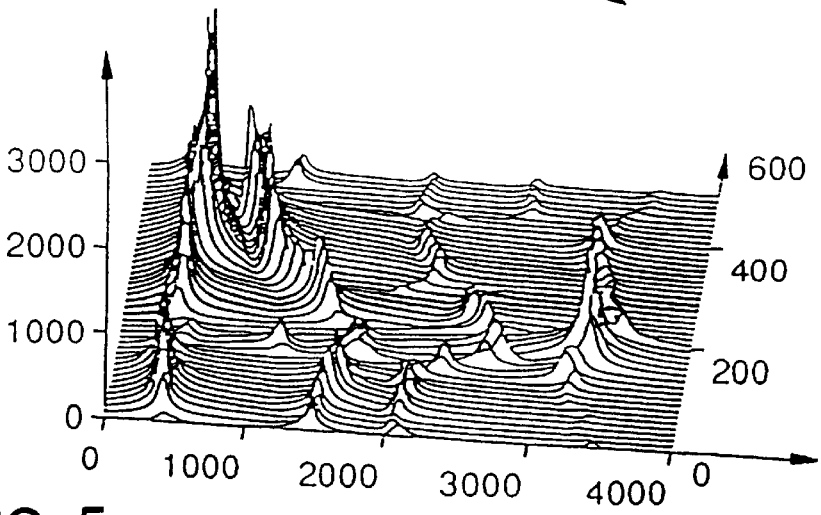
FIG. 5 PRIOR ART
FIG. 5 shows an output signal after processing in the transformation circuit.

The case shown in FIGS. 3–5 involved a noiseless signal, but precisely the same might be performed in case of a noise contaminated signal. In such a case the noise would be reduced considerably, which may be utilized for eliminating noise for persons with impaired hearing ability as well as with normal hearing ability.

Figure 6:
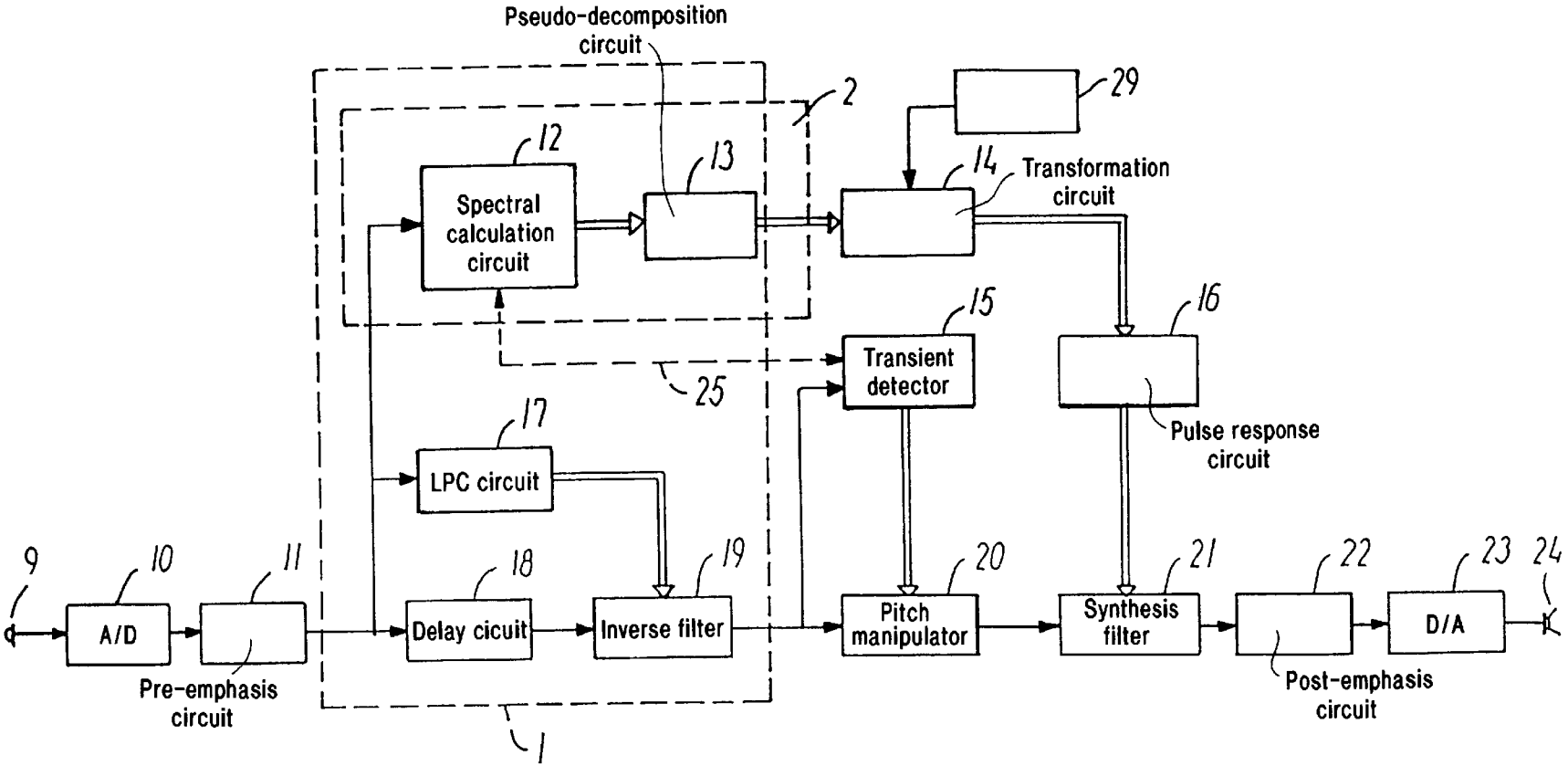
FIG. 6 shows an extended block diagram of the transformation circuit according to the invention.

FIG. 6 shows the transformation circuit of the invention. In the figure, 9 is a microphone which transfers the speech signal from an analog to digital converter 10 and from there to a pre-emphasis filter 11. The signal is then passed into two blocks shown in dashed line, viz. the blocks 1, 2 which correspond to the blocks shown in FIG. 1, viz. the block 1 forming the analysis part and the block 2 forming the decomposition part. As will be seen, the block 2 consists of a circuit 12 for calculating the spectrum of the speech signal, which is then passed into the block 13, in which the signal is pseudodecomposed by means of the circuit 13, which means that the signal is parallel-divided and is described by means of the parameters resonance frequency fo, Q value and power P of the signal at the given resonance frequency. It is noted that the calculation of the spectrum in the block 12 may be performed on the basis of LPC coefficients, on the basis of FFT transformation or optionally on the basis of PLP (perceptual linear prediction) calculation.

After the pseudo-decomposition in the circuit 13, the signal is passed to the transformation circuit 14 in which the spectrum is changed by means of the above-mentioned three parameters. Then, the output from the transformation circuit is passed to a pulse response determining circuit for the transformed filters as well as scaling of the pulse response. The signal is passed from the output of the pulse response circuit 16 to a synthesis filter. As will be seen from the drawing, the signal is passed from the pre-emphasis filter 11 to an LPC circuit 17, whose output is passed to an inverse filter circuit 19 having variable coefficients based on LPC. A delay circuit 18, whose input receives signals from the pre-emphasis circuit 11, is connected to another input of the inverse filter 19. The output of the inverse filter 19 is passed to a pitch manipulator 20 to whose other input a transient detector 15 is connected. Furthermore, as shown by the reference numeral 25, it is possible to establish a connection from the spectral calculation circuit 12 to the transient detector 15. The output of the pitch manipulator 20 is passed to the synthesis filter 21, whose output is passed to a post-emphasis circuit 22, which is passed further on to a digital to analog converter 23 and finally to a loudspeaker 24. As will be seen from FIG. 7, the pitch manipulator 20 consists of a delay circuit 26, a multiplier 27 and a pitch converter 28 intended to change the pitch frequency.

Figure 7:
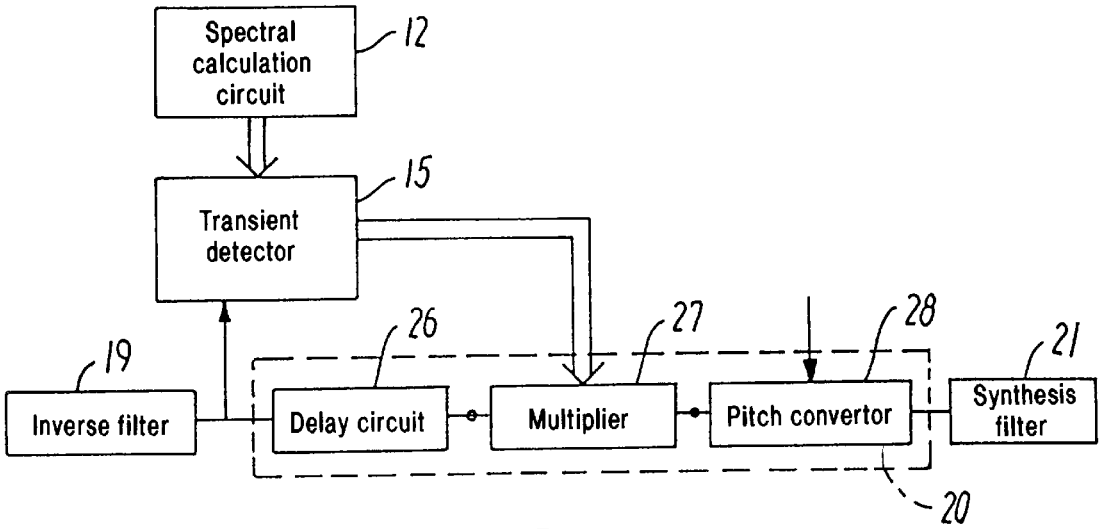
FIG. 7 shows a detailed part of the pitch manipulator of FIG. 6 in block diagram view.
Figure 8:
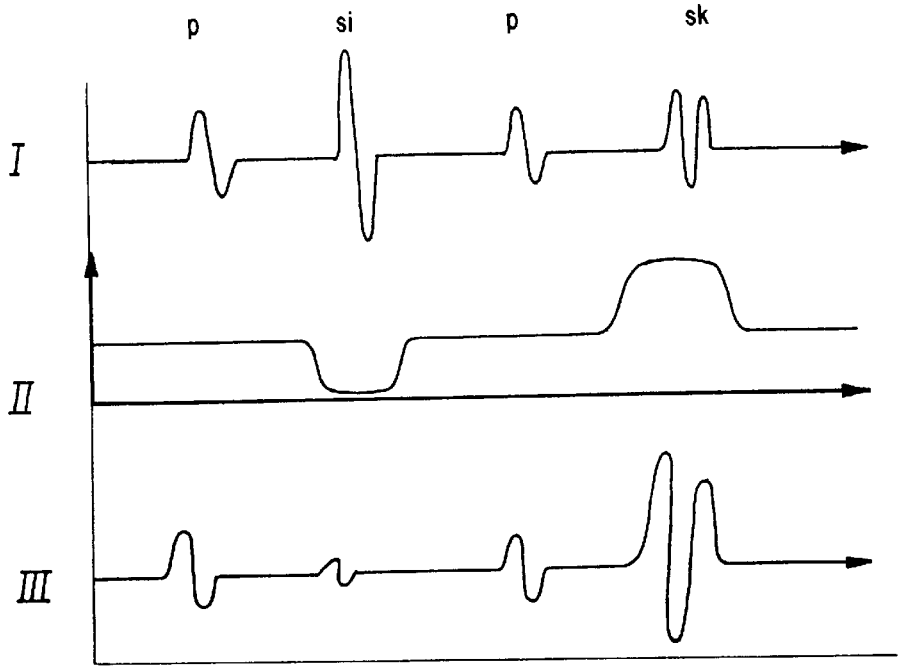
FIG. 8 shows an example of signal processing by means of the circuit of FIGS. 6 and 7.

As regards the quasistationary part of the signal, i.e. in the signal a in FIG. 2, the circuit of FIGS. 6 and 7 operate in the same manner as described before and will therefore not be discussed more fully here. On the other hand, according to the invention, the signal processing in the residual channel is different from the one described before. To illustrate the signal processing in the residual channel reference is made to FIG. 8 showing at I a time signal which consists of two pitch pulses p, a noise pulse si and a stop consonant sk. It is contemplated that this signal emerges from the inverse filter 19 and is supplied to a transient detector 15 and the delay circuit 26. As will be seen at I, the appearance of the pulses is different and thus possible to separate. For example, the transient detector is adapted such that on the basis of the amplitude of the noise pulse it detects said amplitude and signals the multiplier 27 to reduce its amplification, following which the same signal is passed via the delay circuit 26 to the multiplier when the amplification thereof is reduced, which is shown at II below the noise pulse si at I. As regards the pitch pulses p shown on the time axis I, these are processed by means of the pitch converter 28, which forms part of the pitch manipulator 20. With respect to previously known signal processing methods, this is done in the residual signal, as already mentioned, which is of importance if it is desired to transform a voice, e.g. a child's voice to an adult's voice, without the contents of the speech signal being changed. Finally, a stop consonant sk is shown on the time axis. This stop consonant may be changed by means of the multiplier independently of the noise pulses si and the pitch pulses p, as the stop consonants may be identified by combining time domain analysis in the residual signal with spectral information from the LPC analysis. It is hereby possible to increase the amplification as long as the stop consonant exists. The bottom line in FIG. 8 marked III shows the result of the impact of the pitch manipulator on the pitch pulses, the noise transients and the stop consonants.

Figure 9:
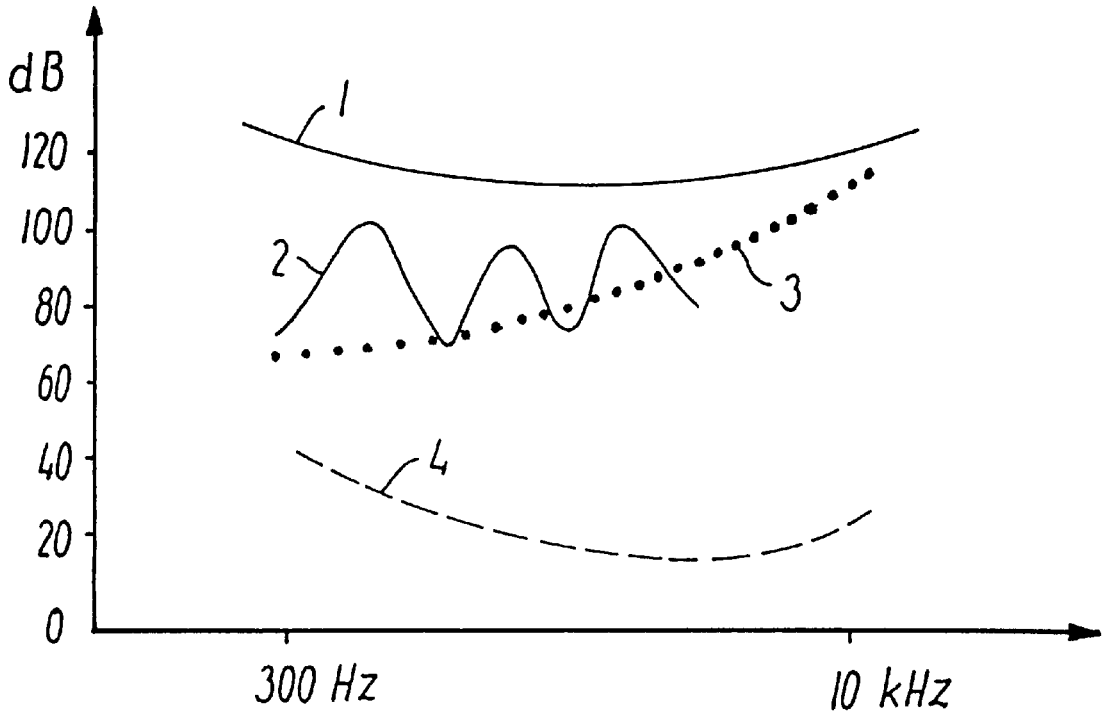
FIG. 9 shows an example of the transformation principles according to the invention.

An example of the use of the transformation principles according to the invention will be described below with reference to FIG. 9.

It is known that a large group of hearing losses is characterized in that the hearing-impaired person has a greatly reduced dynamic range of e.g. 20 dB. The normal dynamic range is about 120 dB. The maximum sound pressure caused discomfort is called UCL below and is of the order of 120 dB. The normal hearing threshold is about 0 dB. In other words, a great hearing loss is accompanied by a small dynamic range. If e.g. the hearing threshold is increased to 90 dB, the dynamic range will be 120−90=30 dB. This dynamic range will additionally be reduced by about 10 dB in connection with speech perception, as the speech level must be about 10 dB above the hearing threshold for the speech perception to be reasonable. This means that the effective dynamic range is reduced to about 20 dB in this case. The "inherent dynamic" of the actual speech signal is of the same order. This should additionally be related to the 'circumstance that the speech level varies considerably when-the distance between the hearing-impaired person and the speaker concerned changes. The speech level drops to about 6 dB, if the speaker moves from 1 to 2 meters' distance to the hearing-impaired person.

It is moreover noted that the hearing loss greatly depends on frequency, and the hearing loss often increases toward higher frequencies, i.e. in many cases hearing is relatively intact in the low frequency range of up to 1000 Hz. This means that the compensation for the reduced hearing loss must normally be frequency-dependent.

Generally, hearing loss compensation is based on the superior principle that the formant frequencies must be located between the curve which represents the individual UCL (uncomfortable level) and a curve which is 2–10 dB above a specific hearing-impaired person's hearing threshold measured individually. This range is called ITS below (individual target space). This superior principle ensures that as much as possible of the speech can be heard by the individual hearing-impaired person.

This adaptation is made currently each time a new frequency spectrum has been calculated. The system of the invention provides full control of the individual formants, and the system is therefore capable of transforming the registered formants optimally above the individual hearing-impaired persons' ICS. The transformation circuit is moreover flexible, because the necessary information on the formants is available in a parametric form and additionally corresponds to an articulatorily natural and correct representation.

It is important that the strength of the formants with respect to each other may be changed with respect to the "natural" strength distribution. This must be seen in relation to the changed mask conditions for the hearing-impaired persons. A hearing loss curve with a greatly increasing hearing loss toward higher frequencies means e.g. that the lowest formant will easily mask the next-lowest formant. Therefore, it will usually be advantageous to establish amplification of the individual formant frequencies which increases toward higher frequencies (seen in relation to the size of the hearing loss at the individual formant frequencies).

A whispering voice is characterized i.a. in that the mutual strength of the various formants is changed with respect to a "normal voice". (Additionally, the pitch pulses are absent, the excitation taking place via a turbulent flow of air). Further, it is an interesting observation that it is often easier for hearing-impaired persons to understand a whispering voice which is amplified suitably (the dynamic of the whispering voice better matches a typical high frequency hearing loss and the resulting changed mask conditions).

The circumstances surrounding the dynamic change of the strength conditions are moreover very important. If the strength adaptation of the formants is made at a wrong pace, temporally, some important items of information on the speech signal modulation pattern are destroyed. This may be described by means of the concept modulation transfer function, cf. technical Review, Brüel og Kjaer, no 2, 1985, called MTF below. It is very important that the speech modulation for modulation frequencies in the range from about 0.5 Hz to 20 Hz is not distorted noticeably.

The general opinion is that a pronounced change in the modulation conditions, e.g. described by means of MTF, is the reason why analog multi-channel compressing hearing aids apparently do not give any noticeable improvement of the speech intelligibility in spite of the fact that the dynamic strength adaptation is considerably better than in conventional single channel hearing aids. Some more recent adaptation strategies for hearing aid users thus also include optimization of the MTF conditions.

It is easy to control the time dynamic conditions in the transformation system of the invention. As described above, the strength of the formants must not be changed at a wrong pace, so that the modulation conditions of the speech are changed to an unacceptable degree. An advanced version of the transformation system allows the MTF conditions to be included in connection with the current transformation of the formants above the individual user's ITS. The above-mentioned conditions are illustrated in FIG. 9, where the graph 1 shows UCL, the graph 2 shows formant structures, f1, f2, f3, where f2 and f3 will be raised more than f1 in terms of strength. The curve 3 shows the characteristic of a person having a typical high frequency hearing loss, while the graph 4 shows the characteristic of a person having normal hearing ability. The transformation circuit of the invention allows the formant frequencies to be manipulated such that these will be between the curves 1 and 3, thereby enabling a hearing-impaired person to perceive the same or essentially the same information as a person having a normal hearing threshold. It is noted that the above-mentioned signal processing provides more possibilities of greater changes in the formant structures, since the pitch frequency is not included, but may be adjusted completely independently.

We claim:

1. A method of transforming a speech signal, comprising separating the speech signal into two signal parts a, b, where a represents the quasistationary part of the signal with information on the formant frequencies, and b represents a residual signal with the transient part of the signal containing information on pitch frequency and stop consonants, said signal b being produced by inverse filtration of the speech signal, characterized in that, after the inverse filtration, the signal b is supplied in parallel to a transient detector and a pitch manipulator comprising a delay circuit which is serially coupled to a multiplier to which the output signal is supplied from the transient detector.

2. A method according to claim 1, characterized in that the multiplier is controlled by a control signal from the transient detector and is adapted to preform time sequential amplification/attenuation of the various signal elements.

3. A method according to claim 1 or 2, characterized in that the output signal from the multiplier is supplied to a pitch converter.

4. A method according to claim 1, characterized in that the transient detector is connected to an output from a spectral calculation circuit whose input is connected to the signal a.

5. A method according to claim 1, characterized in that the residual signal b containing information on pitch frequency, sound transients and stop consonants may be manipulated independently of each other by means of the pitch manipulator.

6. A method according to claim 1, characterized in that strength-dynamic variation of the individual formants is compressed in relation to the hearing-impaired person's actual dynamic range, which is frequency-dependent and depends on the frequency range in which the individual format is present.

7. An apparatus for transforming a speech signal comprising a circuit for splitting the signal into two signal parts a and b, a decomposition circuit, a transformation circuit and an inverse filtering circuit, the first signal part a representing the quasistationary part of the signal which is supplied to said decomposition circuit whose output is supplied to said transformation circuit, the second signal part b representing the transient part of the speech signal which is produced in said inverse filtering circuit, characterized by further comprising a transient detector and a pitch manipulator, the output from the inverse filtering circuit being supplied in parallel to said transient detector and said pitch manipulator, said pitch manipulator comprising a series connection of a delay circuit, a multiplier, and a pitch converter, the output signal from said transient detector being supplied to said multiplier.

8. An apparatus according to claim 7, characterized in that the multiplier, which is controlled by the output signal from the transient detector, provides a time sequential amplification so that the stop consonants are amplified, while the pitch pulses are transmitted with the unchanged strength and the noise pulses are attenuated.

9. An apparatus according to claim 7, characterized in that the multiplier, which is controlled by the output signal from the transient detector, provides a time selective amplification so that the stop consonants are amplified, while pitch pulses are transmitted with the unchanged strength and the noise pulses are attenuated.

* * * * *